US011261719B2

(12) United States Patent
Newhouse et al.

(10) Patent No.: US 11,261,719 B2
(45) Date of Patent: Mar. 1, 2022

(54) USE OF SURFACE AND DOWNHOLE MEASUREMENTS TO IDENTIFY OPERATIONAL ANOMALIES

(71) Applicant: HALLIBURTON ENERGY SERVICES, INC., Houston, TX (US)

(72) Inventors: Lori A. Newhouse, Houston, TX (US); Daniel Joshua Stark, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 19 days.

(21) Appl. No.: 16/827,395

(22) Filed: Mar. 23, 2020

(65) Prior Publication Data

US 2021/0293136 A1 Sep. 23, 2021

(51) Int. Cl.

| | |
|---|---|
| ***E21B 44/00*** | (2006.01) |
| ***E21B 41/00*** | (2006.01) |
| ***E21B 47/26*** | (2012.01) |
| ***E21B 47/12*** | (2012.01) |

(52) U.S. Cl.

CPC ..... *E21B 44/00* (2013.01); *E21B 41/0092* (2013.01); *E21B 47/12* (2013.01); *E21B 47/26* (2020.05); *E21B 2200/22* (2020.05)

(58) Field of Classification Search

CPC ..... E21B 44/00; E21B 47/00; E21B 47/12; E21B 2200/20; E21B 2200/22

See application file for complete search history.

(56) References Cited

U.S. PATENT DOCUMENTS

| | | | | |
|---|---|---|---|---|
| 7,316,278 | B2 | 1/2008 | Hutchinson | |
| 9,091,139 | B2 | 7/2015 | Weng et al. | |
| 9,598,947 | B2 | 3/2017 | Wang et al. | |
| 10,280,722 | B2 | 5/2019 | Bello et al. | |
| 10,280,729 | B2 | 5/2019 | Livescu et al. | |
| 10,280,731 | B2 | 5/2019 | Aitken | |
| 2014/0121973 | A1 | 5/2014 | Buchanan et al. | |
| 2014/0246238 | A1 | 9/2014 | Abbassian et al. | |
| 2015/0107901 | A1 | 4/2015 | Eriksson et al. | |
| 2015/0377012 | A1 | 12/2015 | Liu et al. | |
| 2019/0024495 | A1 | 1/2019 | Wise et al. | |
| 2020/0011158 | A1* | 1/2020 | Xu | G06N 20/00 |
| 2021/0017846 | A1* | 1/2021 | Sun | G06N 3/08 |
| 2021/0108500 | A1* | 4/2021 | Venugopal | E21B 41/00 |
| 2021/0222552 | A1* | 7/2021 | Gao | E21B 47/00 |

OTHER PUBLICATIONS

International Search Report for PCT Application No. PCT/US2020/031013 dated Oct. 15, 2020, 10 pages.

* cited by examiner

*Primary Examiner* — Tara Schimpf
(74) *Attorney, Agent, or Firm* — Polsinelli PC

(57) ABSTRACT

The disclosed technology provides solutions for performing equipment anomaly detection. In particular, a process of the disclosed technology includes steps for receiving surface data from one or more surface sensors, receiving downhole data from one or more downhole sensors, and analyzing a combination of the surface data and the downhole data to determine if an operational anomaly is detected with respect to the surface equipment devices or the downhole equipment devices. Systems and computer-readable media are also provided.

19 Claims, 6 Drawing Sheets

USE OF SURFACE AND DOWNHOLE MEASUREMENTS TO IDENTIFY OPERATIONAL ANOMALIES

TECHNICAL FIELD

The present disclosure pertains to the use of surface and downhole measurements to detect equipment anomalies and in particular, to the use of machine-learning models for performing anomaly classification used to automate operator messages regarding equipment disruptions.

BACKGROUND

In all stages of well construction for hydrocarbon extraction from a subterranean reservoir, including drilling, logging, completion and work-over operations, a means of conveyance (e.g. tubing) is required to lower tools into the well to facilitate these operations. Such tools can include, for example, drill bit/s, various logging tools, a packer, a downhole completion string, a perforating gun, a jetting tool, and the like. The means of conveyance can be a jointed pipe, a continuous pipe such as a coiled tubing (CT), or a slickline or wireline cable.

As the conveyance moves into a well, the tubing is subjected to a variety of forces along its length, as a result of a weight of the tubing itself, a buoyancy force of a fluid in the wellbore, a contact friction with the wall of the wellbore, a pressure inside the wellbore, and a load applied at the bottom of the tool being conveyed (also called weight on bit). Excessive force in tension or compression can cause the failure of the tubing or the tools coupled to the tubing, resulting in failed operations, production losses, or even a loss of the entire well.

BRIEF DESCRIPTION OF THE DRAWINGS

In order to describe the manner in which the above-recited and other advantages and features of the disclosure can be obtained, a more particular description of the principles briefly described above will be rendered by reference to specific embodiments thereof which are illustrated in the appended drawings. Understanding that these drawings depict only exemplary embodiments of the disclosure and are not, therefore, to be considered to be limiting of its scope, the principles herein are described and explained with additional specificity and detail through the use of the accompanying drawings in which.

DETAILED DESCRIPTION

The detailed description set forth below is intended as a description of various configurations of the subject technology and is not intended to represent the only configurations in which the subject technology can be practiced. The appended drawings are incorporated herein and constitute a part of the detailed description. The detailed description includes specific details for the purpose of providing a more thorough understanding of the subject technology. However, it will be clear and apparent that the subject technology is not limited to the specific details set forth herein and may be practiced without these details. In some instances, structures and components are shown in block diagram form in order to avoid obscuring the concepts of the subject technology.

To better plan, execute, and optimize wellbore operations, mathematical models have been developed for computing the torque and drag forces on the drill pipe. However, conventional mathematical models are typically physics-based models that utilize only surface data to determine if operational parameters should be adjusted, or to identify the occurrence of operational anomalies. Because operational parameters for surface-equipment can vary significantly from those of downhole-equipment, surface equipment data may not detect operational anomalies.

The present disclosure is directed, in part, to disclose applications of machine learning to detect anomalies, i.e., deviations from what is considered standard, normal, or otherwise expected. In particular, aspects of the disclosure include anomaly detection utilizing both surface and downhole measurement data to predict equipment malfunctions. Additionally, anomaly detection methods of the disclosure utilize machine-learning models that can be trained on historical data (e.g., coiled tubing operations data), and that can be updated on site using data measured from ongoing jobs. As used herein, operational anomalies can include all manner of detected equipment irregularities. Such irregularities can be identified based on measured operational parameters, such as measures of abnormal pressure, temperature, force, torque, voltage, rotation speeds (e.g., rpm measures), and/or vibrations, etc. By way of example, an anomaly may be identified based on a measured parameter abnormality that is above (or below) a predetermined threshold that is considered to define the limits of standard equipment operation. Such thresholds may be set manually (e.g., by an operator), or determined based on empirical data collected from the operation of one or more surface and/or downhole equipment types. Additionally, operational abnormalities may be identified from combinations of operational parameters or from past historical data for multiple pieces of equipment, for example, using statistical and/or machine-learning models, as explained in further detail below.

Figure 1A:
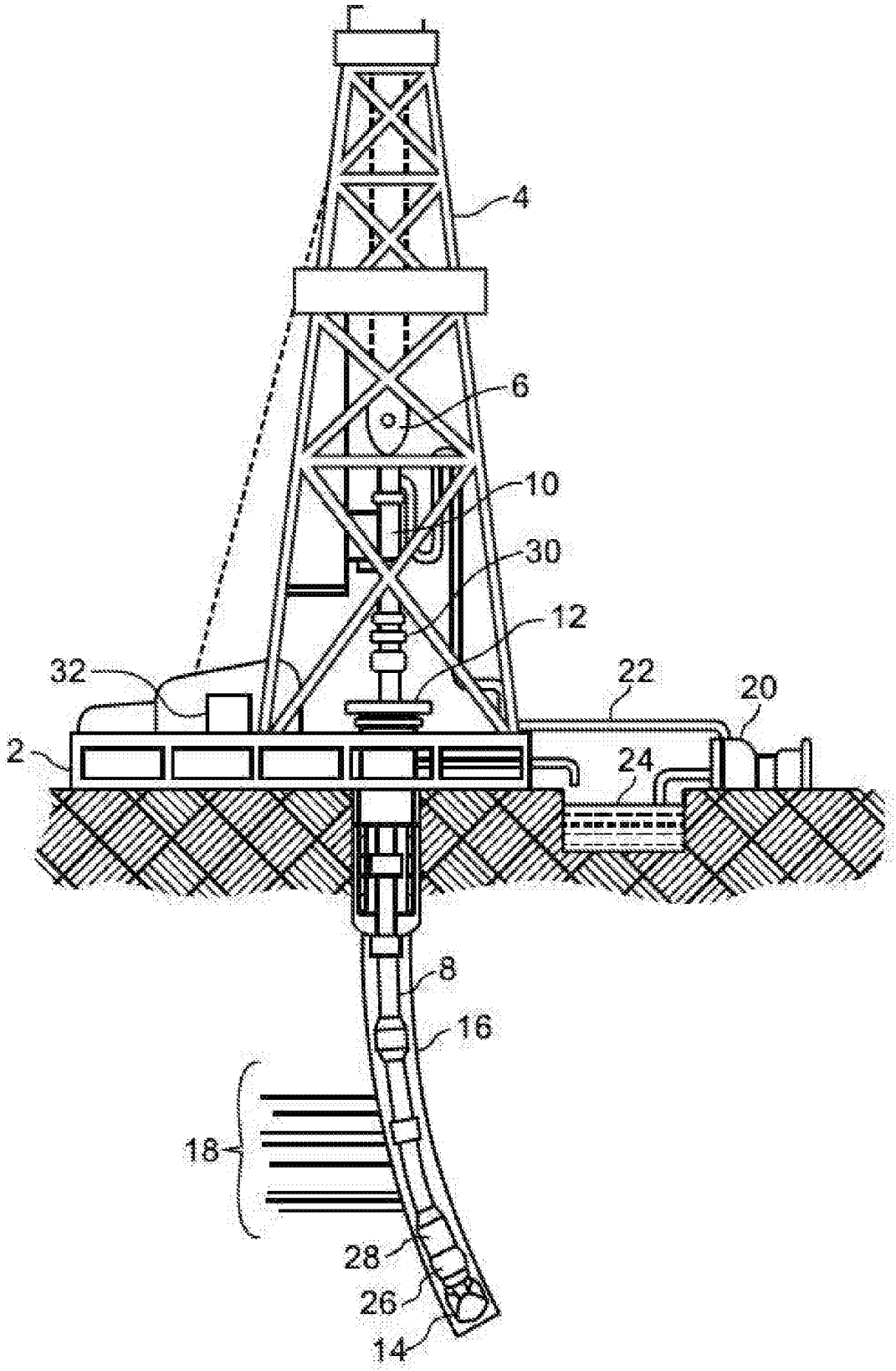
FIG. 1A is a schematic side-view of a wireline logging environment in which a leak detector is deployed in the wellbore.
Figure 1B:
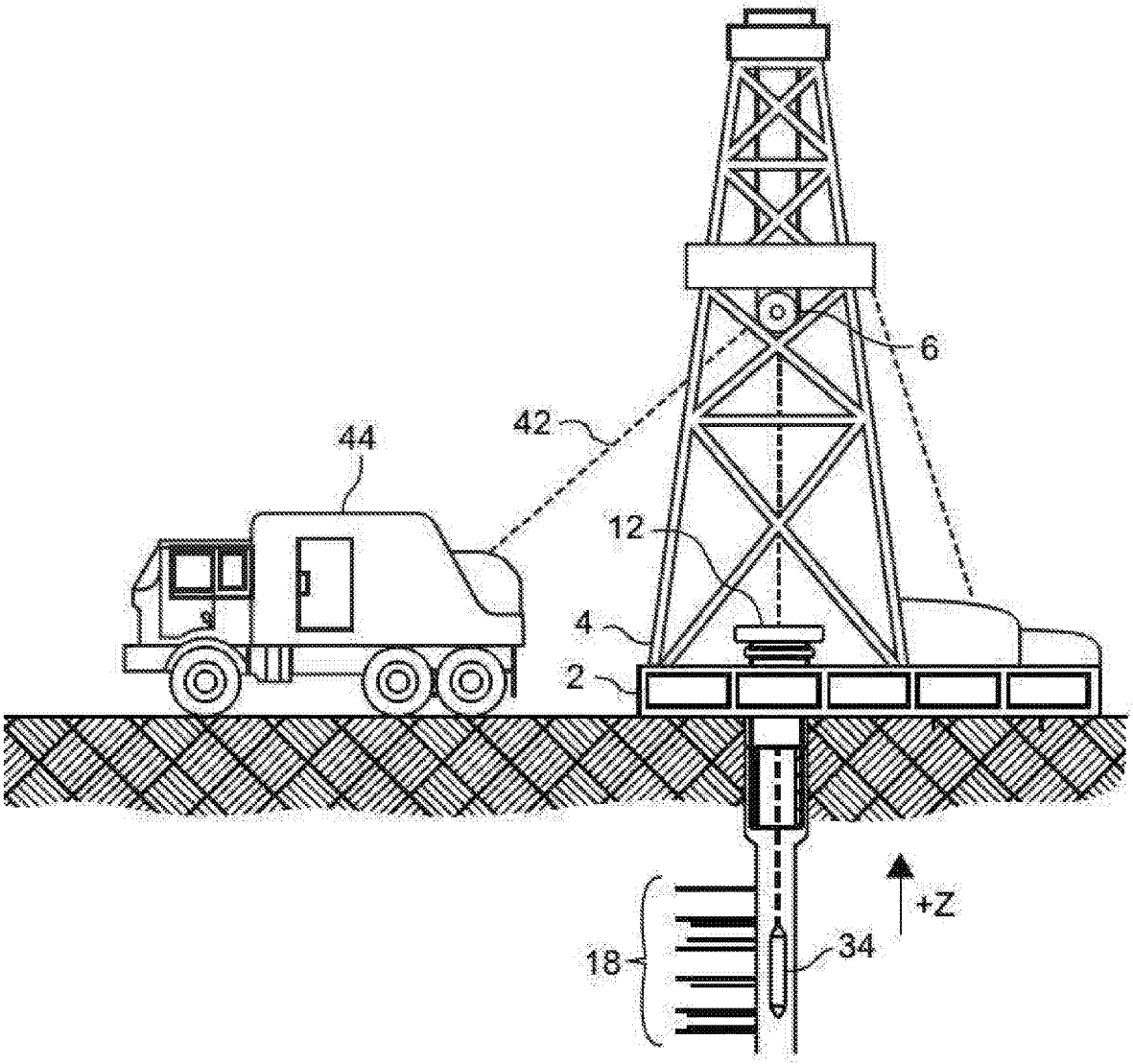
FIG. 1B is a schematic side-view of a (LWD) environment in which the leak detector of FIG. 1A is deployed in the wellbore to detect leaks along the wellbore.

The disclosure now turns to FIGS. 1A-1B provide a brief introductory description of the larger systems that can be employed to practice the concepts, methods, and techniques disclosed herein. A more detailed description of the methods and systems for implementing the improved semblance processing techniques of the disclosed technology will then follow.

FIG. 1A shows an illustrative logging while drilling (LWD) environment. A drilling platform 2 supports derrick 4 having traveling block 6 for raising and lowering drill string 8. Kelly 10 supports drill string 8 as it is lowered through rotary table 12. Drill bit 14 is driven by a downhole motor and/or rotation of drill string 8. As drill bit 14 rotates, it drills a borehole 16 that passes through various formations 18. Pump 20 circulates drilling fluid through a feed pipe 22 to kelly 10, downhole through the interior of drill string 8, through orifices in drill bit 14, back to the surface via the annulus around drill string 8, and into retention pit 24. The drilling fluid transports cuttings from the borehole into pit 24 and aids in maintaining borehole integrity.

Downhole tool 26 can take the form of a drill collar (i.e., a thick-walled tubular that provides weight and rigidity to aid the drilling process) or other arrangements known in the art. Further, downhole tool 26 can include acoustic (e.g., sonic, ultrasonic, etc.) logging tools and/or corresponding components, integrated into the bottom-hole assembly near drill bit 14. In this fashion, as drill bit 14 extends the borehole through formations, the bottom-hole assembly (e.g., the acoustic logging tool) can collect acoustic logging data. For example, acoustic logging tools can include transmitters (e.g., monopole, dipole, quadrupole, etc.) to generate and transmit acoustic signals/waves into the borehole environment. These acoustic signals subsequently propagate in and along the borehole and surrounding formation and create acoustic signal responses or waveforms, which are received/recorded by evenly spaced receivers. These receivers may be arranged in an array and may be evenly spaced apart to facilitate capturing and processing acoustic response signals at specific intervals. The acoustic response signals are further analyzed to determine borehole and adjacent formation properties and/or characteristics. Depending on the implementation, other logging tools may be deployed. For example, logging tools configured to measure electric, nuclear, gamma and/or magnetism levels may be used. Logging tools can also be implemented to measure pressure, temperature, perform fluid identification and/or measure tool orientation, etc.

For purposes of communication, a downhole telemetry sub 28 can be included in the bottom-hole assembly to transfer measurement data to surface receiver 30 and to receive commands from the surface. Mud pulse telemetry is one common telemetry technique for transferring tool measurements to surface receivers and receiving commands from the surface, but other telemetry techniques can also be used, including fiber optic telemetry, electric telemetry, acoustic telemetry through the pipe, electromagnetic (EM) telemetry, etc. In some embodiments, telemetry sub 28 can store logging data for later retrieval at the surface when the logging assembly is recovered.

At the surface, surface receiver 30 can receive the uplink signal from the downhole telemetry sub 28 and can communicate the signal to data acquisition module 32. Module 32 can include one or more processors, storage mediums, input devices, output devices, software, and the like as described in detail with respect to FIG. 5, below. Module 32 can collect, store, and/or process the data received from tool 26 as described herein.

At various times during the process of drilling a well, drill string 8 may be removed from the borehole as shown in FIG. 1B. Once drill string 8 has been removed, logging operations can be conducted using a downhole tool 34 (i.e., a sensing instrument sonde) suspended by a conveyance 42. In one or more embodiments, conveyance 42 can be a cable having conductors for transporting power to the tool and telemetry from the tool to the surface. Depending on implementation, conveyance 42 may also include coiled tubing, wireline, or slickline, etc. For example, conveyance 42 may include piping and systems necessary to perform hydraulic workover-pipe. Downhole tool 34 can have pads and/or centralizing springs to maintain the tool near a central axis of the borehole or to bias the tool towards the borehole wall as the tool is moved downhole or uphole.

Downhole tool 34 can include an acoustic or sonic logging instrument that collects acoustic logging data within the borehole 16. As mentioned above, other logging instruments may also be used. A logging facility 44 includes a computer system, such as those described with reference to FIG. 5, for collecting, storing, and/or processing the measurements gathered by logging tool 34.

In one or more embodiments, the conveyance 42 of the downhole tool 34 may be at least one of wires, conductive or non-conductive cable (e.g., slickline, etc.), as well as tubular conveyances, such as coiled tubing, pipe string, or downhole tractor. Downhole tool 34 can have a local power supply, such as batteries and/or a downhole generator, or the like. When employing non-conductive cable, coiled tubing, pipe string, or downhole tractor, communication can be supported using, for example, wireless protocols (e.g. EM, acoustic, etc.), and/or measurements and logging data may be stored in local memory for subsequent retrieval. In some aspects, electric or optical telemetry is provided using conductive cables and/or fiber optic signal-paths.

Although FIGS. 1A and 1B depict specific borehole configurations, it is understood that the present disclosure is equally well suited for use in wellbores having other orientations including vertical wellbores, horizontal wellbores, slanted wellbores, multilateral wellbores and the like. While FIGS. 1A and 1B depict an onshore operation, it should also be understood that the present disclosure is equally well suited for use in offshore operations. Moreover, the present disclosure is not limited to the environments depicted in FIGS. 1A and 1B, and can also be used, for example, in other well operations such as production tubing operations, jointed tubing operations, coiled tubing operations, combinations thereof, and the like.

Figure 2:
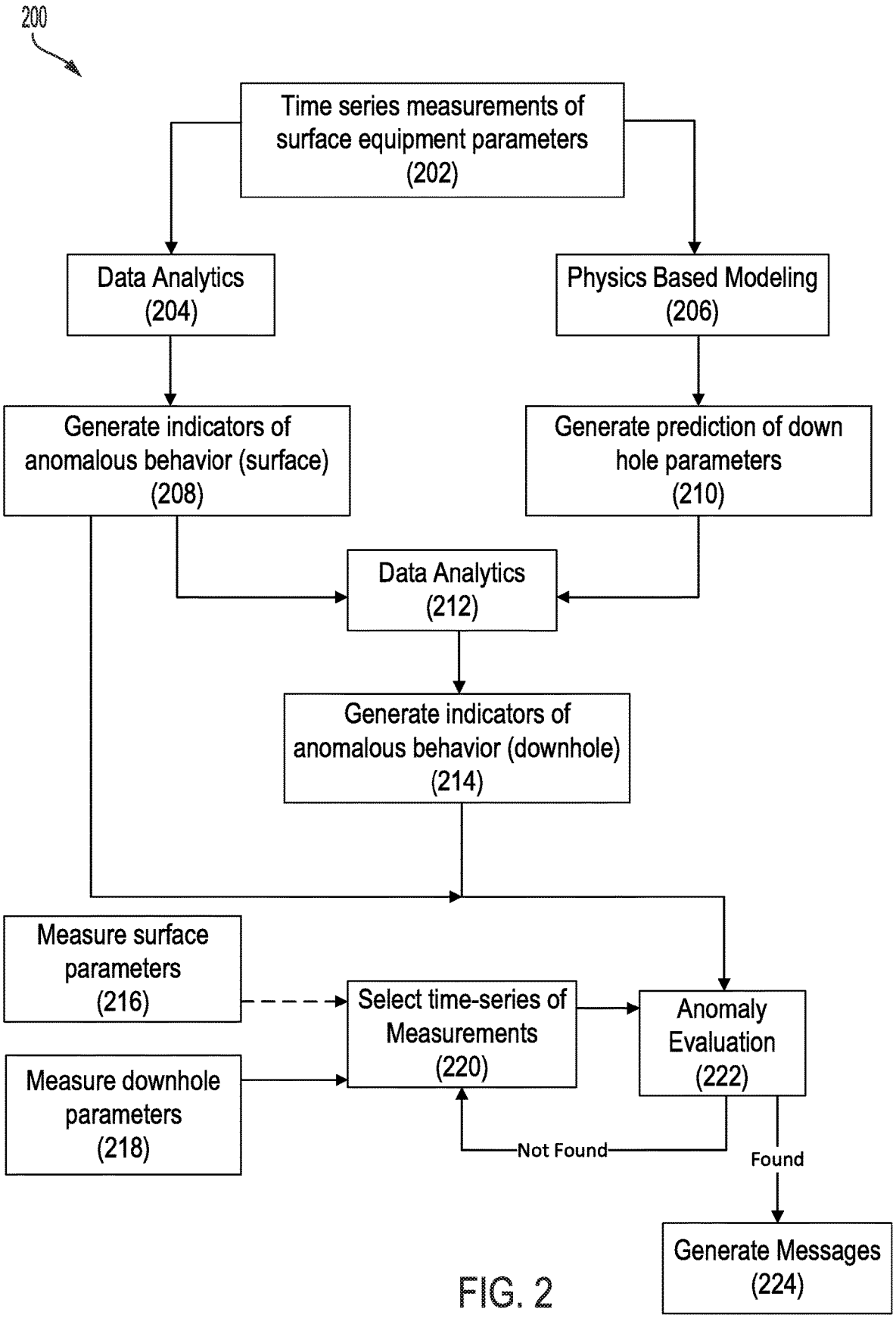
FIG. 2 is a block diagram of an equipment anomaly detection system, according to some aspects of the disclosed technology.

FIG. 2 is a block diagram of an equipment anomaly detection system 200, according to some aspects of the disclosed technology. It is understood that various functional blocks of detection system 200 can be implemented using different software, firmware and/or hardware systems, for example, that may be contained in a discrete computing system, such as a server, workstation, or a supervisory control and data acquisition system. Alternatively, various functions performed by detection system 200 can be performed by disparate computing units, as well as distributed physical or virtual computing systems, such as those implemented in a distributed computing cluster, or in a virtualized computing environment (e.g., in a cloud computing platform), without departing from the scope of the disclosed technology. As such, processing necessary to implement any of the functions of system 200 can be performed by downhole devices, or by surface computing devices, or a combination thereof, without departing from the scope of the disclosed technology.

In block 202, a time series of measurements for surface equipment parameters are collected. Surface equipment parameters can relate to any physical measurements that are associated with surface equipment, such as coiled tubing insertion system components. By way of example, such physical measurements can include but are not limited to measurements relating to: reels, goosenecks, guide arches, injectors, engines, grippers, strippers and/or pumps, etc. By way of example, time series measurements can include measures of pressure, temperature, force, torque, voltage, rotation speeds (e.g., rpm measures), and/or vibrations, etc. In some aspects, surface equipment parameters can include data other than time-series measurements, such as metadata collected with respect to various equipment devices.

The surface parameters are then provided to data analytics module 204 and physics-based modeling unit 206 for processing. Data analytics module 204 is configured to perform calculations to identify operational anomalies (208) using statistical models. For example, data analytics module 204 may be configured to calculate failure probabilities based on data pertaining to historic anomalies for one or more equipment types, and/or based on other statistical models that can be used to predict the same. In contrast, physics based modeling unit 206 is configured to predict downhole parameters or characteristics (210) using physics-based conservation equations, such as using mathematical relationships between quantities of mass, energy, and/or momentum, etc. In some aspects, physics modeling unit 206 can use other physical relationships, including but not limited to: constitutive equations, fluid dynamics, rheological and metallurgical equations, partial differential equations, integral transforms, finite element modeling, and/or other physics-based relationships, that can be combined with sensor measurements. In some implementations, data analytics module 204 can be configured to identify anomalous operational behaviors in one or more surface equipment devices using machine-learning (ML) approaches. Inputs to data analytics module 204 can include parameters relating to one or more pieces of equipment. Based on these inputs, data analytics module 204 can identify measurement values or patterns of measurement values that are indicative of anomalous equipment states or behavior (208). That is, outputs of data analytics module, can include data identifying one or more pieces equipment along with an indicator of an anomaly type, e.g., identifications of sub-optimal performance, excessive wear, and/or impending failure, etc. (208). Concurrently, physics-based modeling unit 206 is configured to generate predictions of downhole parameters (210), such as pressure, force and/or vibration, for example, that relate to one or more downhole equipment devices.

Next, data analytics module 212 generates/predicts indicators of anomalous downhole behavior (214) based on the indicators of surface anomalies (208), and the predicted downhole parameters (210). That is, data analytics module 212 is configured to receive indicators of anomalous (surface) behavior (208), and predicted downhole parameters (210), and to produce/generate potential indicators of anomalous behavior for one or more downhole equipment devices. As indicated in the schematic of system 200, such indicators are provided by analytics module 212 to anomaly evaluation module 222. As further illustrated, anomaly evaluation module 222 also directly receives surface indicators of anomalous behavior (208) that are generated by data analytics module 204.

While a job is in progress, anomaly evaluation module 222 can optionally receive measures of surface parameters (216), and downhole parameters (218), which are provided as a select time series of measurements 220. As used herein, downhole parameters 218 can include downhole equipment device measurements including load, torque, pressure, and/or vibration measurements, etc. As such, anomaly evaluation module 222 is configured to receive surface parameter measurements (216), downhole parameter measurements (218), and to evaluate those received measures against anomalous behavior indicators (214), for example, to determine if anomalous indicators are appearing in the current job measurements.

In some aspects, anomaly evaluation module 222 can include one or more machine-learning models. Depending on the desired implementation, the machine-learning model/s can be pre-trained to improve speed/performance. By way of example, model training can be performed using similar e.g., location-specific data. Training of the machine-learning model can be done wholly or partially on-site and may include on-line training, for example, that is performed using on-site data collected in real-time (or near real-time). Examples of various machine-learning deployments are discussed in further detail with respect to FIG. 4, below.

If anomaly evaluation module 222 does not detect any anomalies with respect to a current set of time-series of measurement data (220), then a new time series is input for evaluation. However, if one or more anomalies are detected, then an operator message can be generated (224) and provided to a drilling operator, and logged by a data storage system. By way of example, operator messages may provide indications of detected gripper slips, indications that a reel back tension is too small, and/or that a lock-up is predicted before reaching a target depth. It is understood that operator messages can contain information pertaining to any aspect of equipment operation, without departing from the scope of the disclosed technology.

In some aspects, results generated by anomaly evaluation module 222 may be provided back to data analytics module 212. In such instances, parameter adjustments can be made at data analytics module 212, for example, to improve the generated indicators of anomalous downhole equipment behaviors. Additionally, anomaly evaluation may be influenced by operator decisions. For example, if a user indicates that an alert should be ignored (e.g., through a user button) the weight of the system state that produced the alert may be reduced and/or the threshold values that produced the alert can be adjusted, so that the alert is generated less frequently. In some implementations, the issuance of the alert can be fed back into the ML model (of anomaly evaluation module 222), such that multiple alerts in a certain time or a certain sequence of alerts can be learned to indicate a potential future anomaly.

Figure 3:
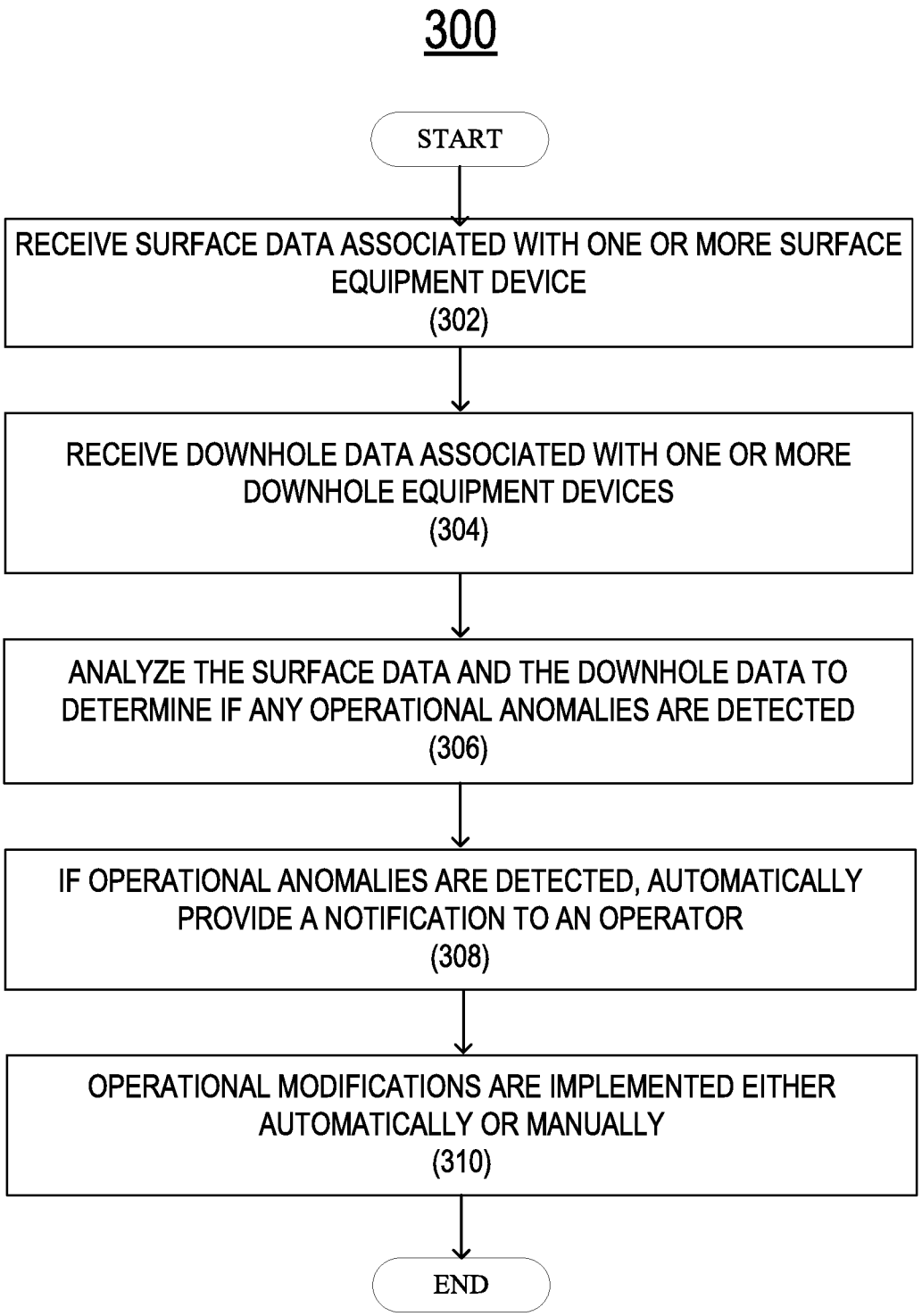
FIG. 3 is a flow diagram of an example method for performing equipment anomaly detection using combined surface and downhole data, according to some aspects of the disclosed technology.

FIG. 3 is a flow diagram of an example process 300 for performing equipment anomaly detection using a combination of surface and downhole data, according to some aspects of the disclosed technology. Process 300 begins with step 302 in which surface data associated with one or more surface equipment devices is received. As discussed above, surface data can include measurements relating to one or more: reels, goosenecks, guide arches, injectors, and/or pumps, etc. By way of example, surface data can include measures of particle concentration in the hydraulic lines, load on the gooseneck, pressures in the hydraulic lines, vibrations, angular velocity of the reel, etc.

In step 304, downhole data associated with one or more downhole equipment devices is received. Similar to the surface data, downhole measurements can include measures of annular and tubular pressures, annular and tubular temperatures, weight on bit, torque, inclination, tool-face, fluid type, gamma, neutron levels, camera images, and/or vibration, etc.

It is understood that steps 302 and 304 can be performed in any order, or in parallel, depending on the desired implementation. By way of example, step 304 may precede step 302, or performed in parallel with step 302. In other implementations, the order of steps 302 and 304 may change, for example, in a cyclic manner.

At step 306, the surface data and the downhole data are analyzed to determine if any operational anomalies are detected. In some implementations, anomaly detection may be specifically performed for surface equipment or downhole equipment devices. However, anomaly detection can be performed for all equipment devices (surface and downhole) concurrently, without departing from the scope of the disclosed technology.

In step 308, one or more notifications or messages can be generated in response to a positive anomaly detection. Notifications can be provided to one or more drilling operators, for example, so that operational modifications can be made to improve drilling, or to avoid equipment losses. For example, operational modifications may include the halting of equipment operations and/or the modification of equipment operators to improve operational safety and/or equipment performance. It is understood that operational modifications may be performed in an automatic (automated) manner, or performed manually, for example, by a human operator.

In step 310, one or more operational modifications are implemented. Operational modifications can be implemented by an operator (manually), in response to the notification generated at step 308. In other implementations, operational modifications may be implemented in an automated manner in which parameters for one or more equipment devices are automatically modified/regulated in response to an anomaly detected in step 308.

Figure 4:
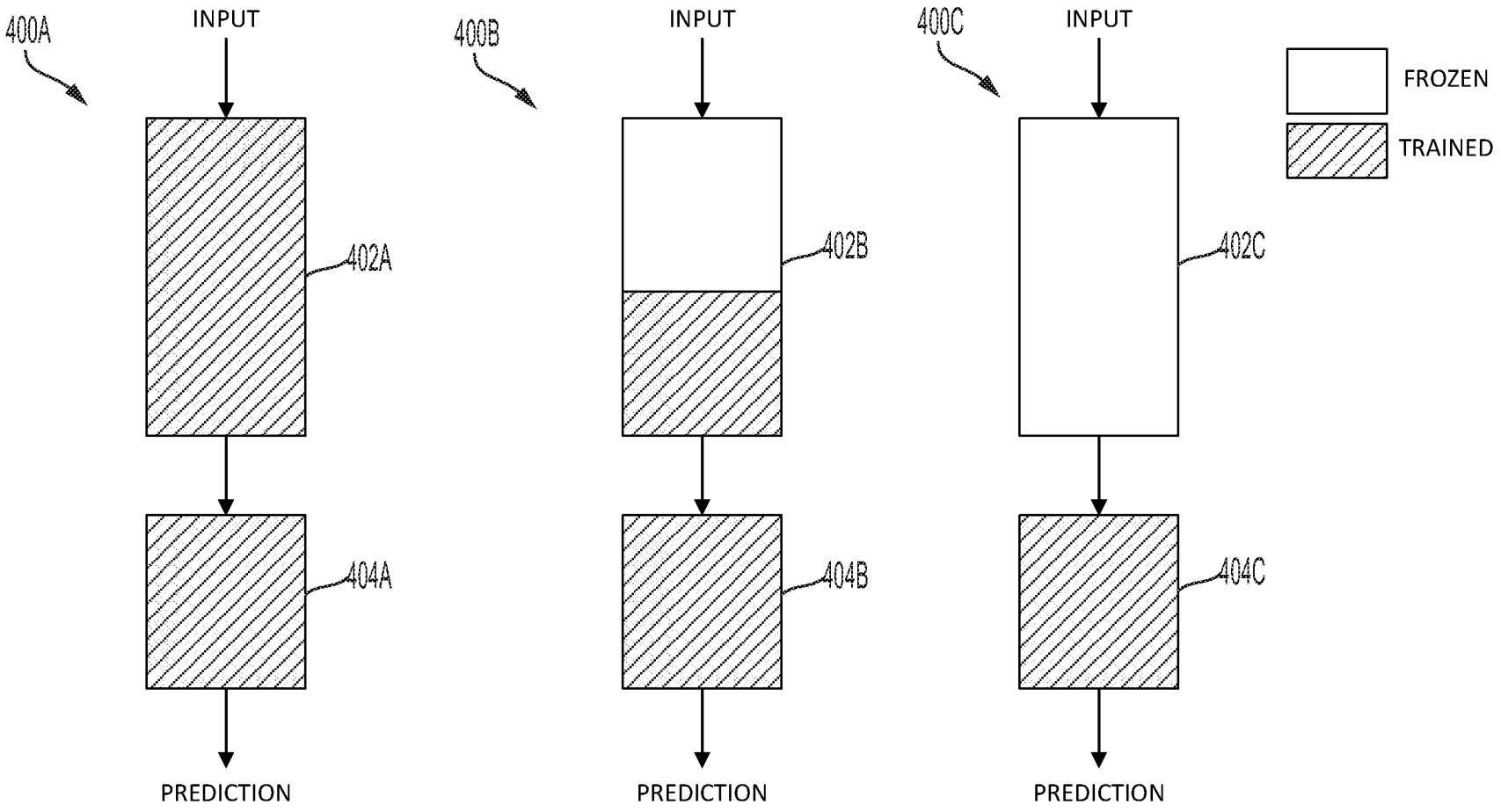
FIG. 4 illustrates block diagrams of various machine-learning implementations that can be used to perform anomaly detection in various implementations of the disclosed technology.

FIG. 4 illustrates block diagrams of various machine-learning (ML) implementations 400 that can be used to perform anomaly detection in various implementations of the disclosed technology. Specifically, ML implementation 400A represents a configuration in which a convolutional base 402A and classifier 404A are trained prior to deployment. Such configurations may be preferred where the ML model is being implemented in a wellbore location for which historic data has been collected or that is believe to be highly similar to other wellbore locations for which data has been collected.

The example of ML implementation 400B represents a configuration in which convolutional base 402B has been partially trained, and in which model 404B is trained. Finally, the example of ML implementation 400C represents a configuration in which convolutional base 402C has been fully frozen, but in which classifier 404C is trained. It is understood that different ML configurations can be selected based on the availability of historic (feature) information, as well as the desired speed of implementation at the time the job is to be performed.

Figure 5:
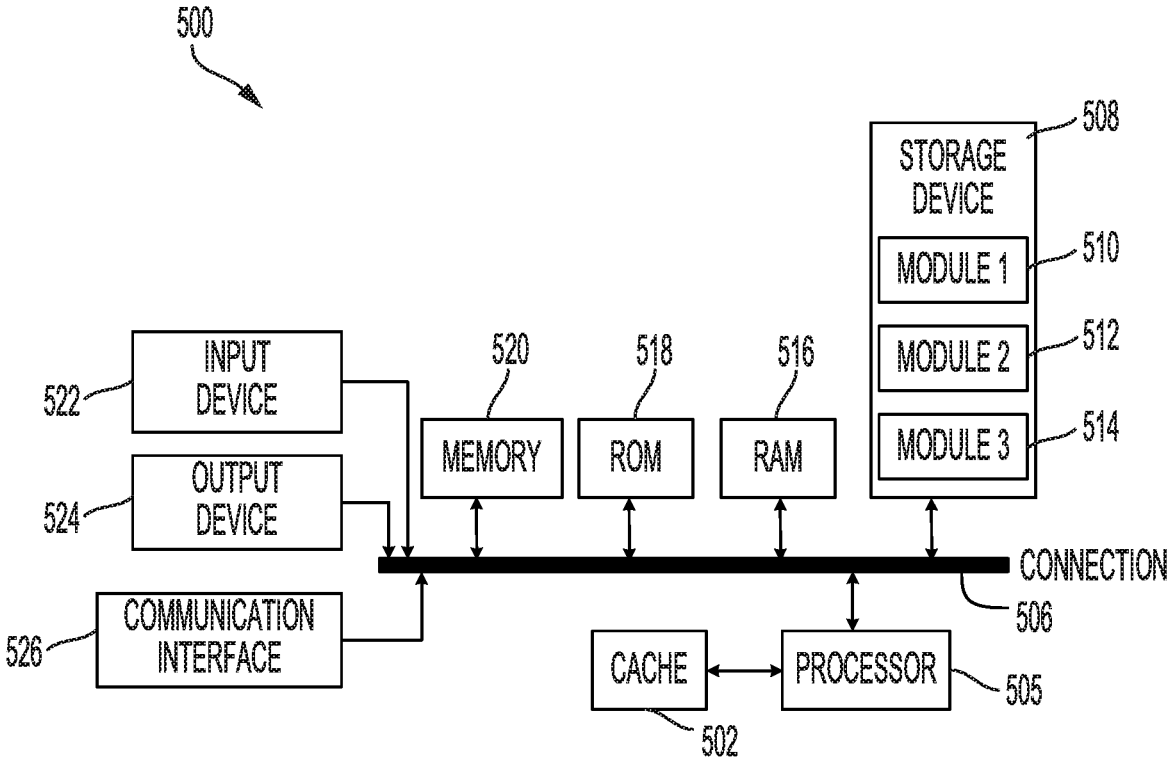
FIG. 5 is a schematic diagram of an example system embodiment.

FIG. 5 is a schematic diagram of an example system embodiment. Depending on implementation, system architecture 500 could be implemented at the surface or downhole. Additionally, it is understood that the architecture of system 500 could be implemented in both surface and downhole hardware, depending on the desired implementation. In the example of system architecture 500, components of the system are in electrical communication with each other using bus 506. System architecture 500 can include a processing unit (CPU or processor) 505, as well as a cache 502, that are variously coupled to system bus 506. Bus 506 connects various system components including system memory 520, (e.g., read only memory (ROM) 518 and random access memory (RAM) 516), to processor 805. System architecture 800 can include a cache of high-speed memory connected directly with, in close proximity to, or integrated as part of the processor 505. System architecture 500 can copy data from memory 520 and/or the storage device 508 to the cache 502 for quick access by the processor 505. In this way, the cache can provide a performance boost that avoids processor 505 delays while waiting for data. These and other modules can control or be configured to control processor 505 to perform various actions. Other system memory 520 may be available for use as well. Memory 520 can include multiple different types of memory with different performance characteristics. Processor 805 can include any general-purpose processor and a hardware module or software module, such as module 1 (510), module 2 (512), and module 3 (514) stored in storage device 508, configured to control processor 505 as well as a special-purpose processor where software instructions are incorporated into the actual processor design. Processor 505 may essentially be a completely self-contained computing system, containing multiple cores or processors, a bus, memory controller, cache, etc. A multi-core processor may be symmetric or asymmetric.

To enable user interaction with the computing system architecture 500, input device 522 can represent any number of input mechanisms, such as surface or downhole sensors, microphone for speech, a touch-sensitive screen for gesture or graphical input, keyboard, mouse, motion input, and so forth. An output device 524 can also be one or more of a number of output mechanisms. In some instances, multi-modal systems can enable a user to provide multiple types of input to communicate with the computing system architecture 500. Communications interface 526 can generally govern and manage the user input and system output. There is no restriction on operating on any particular hardware arrangement and therefore the basic features here may easily be substituted for improved hardware or firmware arrangements as they are developed.

Storage device 508 is a non-volatile memory and can be a hard disk or other types of computer readable media which can store data that are accessible by a computer, such as magnetic cassettes, flash memory cards, solid state memory devices, digital versatile disks, cartridges, random access memories (RAMs) 516, read only memory (ROM) 518, and hybrids thereof.

Storage device 508 can include software modules 510, 512, 514 for controlling processor 505. Other hardware or software modules are contemplated. Storage device 508 can be connected to the system bus 506. In one aspect, a hardware module that performs a particular function can include the software component stored in a computer-readable medium in connection with the necessary hardware components, such as processor 505, bus 506, output device 524, and so forth, to carry out various functions of the disclosed technology.

Embodiments within the scope of the present disclosure may also include tangible and/or non-transitory computer-readable storage media or devices for carrying or having computer-executable instructions or data structures stored thereon. Such tangible computer-readable storage devices can be any available device that can be accessed by a general purpose or special purpose computer, including the functional design of any special purpose processor as described above. By way of example, and not limitation, such tangible computer-readable devices can include RAM, ROM, EEPROM, CD-ROM or other optical disk storage, magnetic disk storage or other magnetic storage devices, or any other device which can be used to carry or store desired program code in the form of computer-executable instructions, data structures, or processor chip design. When information or instructions are provided via a network or another communications connection (either hardwired, wireless, or combination thereof) to a computer, the computer properly views the connection as a computer-readable medium. Thus, any such connection is properly termed a computer-readable medium. Combinations of the above should also be included within the scope of the computer-readable storage devices.

Computer-executable instructions include, for example, instructions and data which cause a general-purpose computer, special purpose computer, or special purpose processing device to perform a certain function or group of functions. Computer-executable instructions also include program modules that are executed by computers in standalone or network environments. Generally, program modules include routines, programs, components, data structures, objects, and the functions inherent in the design of special-purpose processors, etc. that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described in such steps.

Other embodiments of the disclosure may be practiced in network computing environments with many types of computer system configurations, including personal computers, hand-held devices, multi-processor systems, microprocessor-based or programmable consumer electronics, network PCs, minicomputers, mainframe computers, and the like. Embodiments may also be practiced in distributed computing environments where tasks are performed by local and remote processing devices, for example, that are linked (either by hardwired links, wireless links, or by a combination thereof) through a communications network. In a distributed computing environment, program modules may be located in both local and remote memory storage devices.

The various embodiments described above are provided by way of illustration only and should not be construed to limit the scope of the disclosure. For example, the principles herein apply equally to optimization as well as general improvements. Various modifications and changes may be made to the principles described herein without following the example embodiments and applications illustrated and described herein, and without departing from the spirit and scope of the disclosure. Claim language reciting "at least one of" a set indicates that one member of the set or multiple members of the set satisfy the claim.

STATEMENTS OF THE DISCLOSURE

Statement 1: a method for preventing operational disruptions in hydrocarbon extraction equipment, the method comprising: receiving surface data from one or more surface sensors, wherein the surface data comprises measurements associated with one or more of the surface equipment devices; receiving downhole data from one or more downhole sensors, wherein the downhole data comprises measurements associated with operation of one or more downhole equipment devices; and analyzing a combination of the surface data and the downhole data to determine if an operational anomaly is detected with respect to the one or more surface equipment devices or the one or more downhole equipment devices.

Statement 2: the method of statement 1, wherein analyzing the surface data and the downhole data further comprises: providing at least a portion of the surface data and the downhole data to a machine learning model; and receiving an anomaly prediction from the machine learning model, wherein the anomaly prediction comprises statistical confidence associated with a malfunction of the one or more surface equipment device or the one or more downhole equipment devices.

Statement 3: the method of any of statements 1-2, further comprising: further comprising: collecting operational data for the one or more surface equipment devices; and updating a machine learning model for performing operational anomaly detection using the operational data for the one or more surface equipment devices.

Statement 4: the method of any of statements 1-3, further comprising: collecting operational data for the one or more downhole equipment devices; and updating a machine learning model for performing operational anomaly detection using the operational data for the one or more downhole equipment devices.

Statement 5: the method of any of statements 1-4, further comprising: generating a warning notification if an operational anomaly is detected.

Statement 6: the method of any of statements 1-5, further comprising: automatically modifying operation of at least one surface equipment device if an operational anomaly is detected.

Statement 7: the method of any of statements 1-6, further comprising: automatically halting operation of at least one downhole equipment device if an operational anomaly is detected.

Statement 8: a system for preventing operational disruptions in hydrocarbon extraction equipment, the system comprising: one or more processors; and a non-transitory memory coupled to the one or more processors, wherein the memory comprises instruction configured to cause the processors to perform operations for: receiving surface data from one or more surface sensors, wherein the surface data comprises measurements associated with one or more of the surface equipment devices; receiving downhole data from one or more downhole sensors, wherein the downhole data comprises measurements associated with operation of one or more downhole equipment devices; and analyzing a combination of the surface data and the downhole data to determine if an operational anomaly is detected with respect to the one or more surface equipment devices or the one or more downhole equipment devices.

Statement 9: the system of statement 8, wherein analyzing the surface data and the downhole data further comprises: providing at least a portion of the surface data and the downhole data to a machine learning model; and receiving an anomaly prediction from the machine learning model, wherein the anomaly prediction comprises statistical confidence associated with a malfunction of the one or more surface equipment device or the one or more downhole equipment devices.

Statement 10: the system of any of statements 8-9, wherein the instructions are further configured to cause the processors to perform operations for: collecting operational data for the one or more surface equipment devices; and updating a machine learning model for performing operational anomaly detection using the operational data for the one or more surface equipment devices.

Statement 11: the system of any of statements 9-10, wherein the instructions are further configured to cause the processors to perform operations for: collecting operational data for the one or more downhole equipment devices; and updating a machine learning model for performing operational anomaly detection using the operational data for the one or more downhole equipment devices.

Statement 12: the system of any of statements 9-11, wherein the instructions are further configured to cause the processors to perform operations for: generating a warning notification if an operational anomaly is detected.

Statement 13: the system of any of statements 9-12, wherein the instructions are further configured to cause the processors to perform operations for: automatically halting operation of at least one surface equipment device if an operational anomaly is detected.

Statement 14: the system of any of statements 9-13, wherein the instructions are further configured to cause the processors to perform operations for: automatically halting operation of at least one downhole equipment device if an operational anomaly is detected.

Statement 15: a tangible, non-transitory, computer-readable media having instructions encoded thereon, the instructions, when executed by a processor, are operable to perform operations for: receiving surface data from one or more surface sensors, wherein the surface data comprises measurements associated with one or more of the surface equipment devices; receiving downhole data from one or more downhole sensors, wherein the downhole data comprises measurements associated with operation of one or more downhole equipment devices; and analyzing a combination of the surface data and the downhole data to determine if an operational anomaly is detected with respect to the one or more surface equipment devices or the one or more downhole equipment devices.

Statement 16: the tangible, non-transitory, computer-readable media of statement 15, wherein analyzing the surface data and the downhole data further comprises: providing at least a portion of the surface data and the downhole data to a machine learning model; and receiving an anomaly prediction from the machine learning model, wherein the anomaly prediction comprises statistical confidence associated with a malfunction of the one or more surface equipment device or the one or more downhole equipment devices.

Statement 17: the tangible, non-transitory, computer-readable media of any of statements 15-16, wherein the instructions are further configured to cause the processors to perform operations for: collecting operational data for the one or more surface equipment devices; and updating a machine learning model for performing operational anomaly detection using the operational data for the one or more surface equipment devices.

Statement 18: the tangible, non-transitory, computer-readable media of any of statements 15-17, wherein the instructions are further configured to cause the processors to perform operations for: collecting operational data for the one or more downhole equipment devices; and updating a machine learning model for performing operational anomaly detection using the operational data for the one or more downhole equipment devices.

Statement 19: the tangible, non-transitory, computer-readable media of any of statements 15-18, computer-readable media of claim 15, wherein the instructions are further configured to cause the processors to perform operations for: generating a warning notification if an operational anomaly is detected.

Statement 20: the tangible, non-transitory, computer-readable media of any of statements 15-19, computer-readable media of claim 15, wherein the instructions are further configured to cause the processors to perform operations for: automatically halting operation of at least one surface equipment device if an operational anomaly is detected.

What is claimed is:

1. A method for preventing operational disruptions in hydrocarbon extraction equipment, the method comprising:

receiving surface data from one or more surface sensors, wherein the surface data comprises measurements associated with one or more surface equipment devices;

receiving downhole data from one or more downhole sensors, wherein the downhole data comprises measurements associated with operation of one or more downhole equipment devices; and analyzing a combination of the surface data and the downhole data to determine if an operational anomaly is detected with respect to the one or more surface equipment devices or the one or more downhole equipment devices, wherein analyzing the surface data and the downhole data further comprises:

calculating a failure probability of the one or more surface equipment devices or the one or more downhole equipment devices based on the combination of the surface data and the downhole data, as well as data pertaining to historic anomalies for one or more equipment types; and outputting data identifying at least one piece of equipment along with an indicator of an anomaly type, the anomaly type comprising an impending failure of the at least one piece of equipment.

2. The method of claim 1, further comprising:

collecting operational data for the one or more surface equipment devices; and updating a machine learning model for performing operational anomaly detection using the operational data for the one or more surface equipment devices.

3. The method of claim 1, further comprising:

collecting operational data for the one or more downhole equipment devices; and updating a machine learning model for performing operational anomaly detection using the operational data for the one or more downhole equipment devices.

4. The method of claim 1, further comprising:

generating a warning notification if the operational anomaly is detected.

5. The method of claim 1, further comprising:

automatically modifying operation of at least one surface equipment device if the operational anomaly is detected.

6. The method of claim 1, further comprising:

automatically modifying operation of at least one downhole equipment device if the operational anomaly is detected.

7. The method of claim 1, wherein calculating comprises providing at least a portion of the surface data and the downhole data to a machine learning model.

8. A system for preventing operational disruptions in hydrocarbon extraction equipment, the system comprising:

one or more processors; and a non-transitory memory coupled to the one or more processors, wherein the memory comprises instructions configured to cause the processors to perform operations for:

receiving surface data from one or more surface sensors, wherein the surface data comprises measurements associated with one or more surface equipment devices;

receiving downhole data from one or more downhole sensors, wherein the downhole data comprises measurements associated with operation of one or more downhole equipment devices; and analyzing a combination of the surface data and the downhole data to determine if an operational anomaly is detected with respect to the one or more surface equipment devices or the one or more downhole equipment devices, wherein analyzing the surface data and the downhole data further comprises:

calculating a failure probability of the one or more surface equipment devices or the one or more downhole equipment devices based on the combination of the surface data and the downhole data, as well as data pertaining to historic anomalies for one or more equipment types; and outputting data identifying at least one piece of equipment along with an indicator of an anomaly type, the anomaly type comprising an impending failure of the at least one piece of equipment.

9. The system of claim 8, wherein the instructions are further configured to cause the processors to perform operations for:

collecting operational data for the one or more surface equipment devices; and updating a machine learning model for performing operational anomaly detection using the operational data for the one or more surface equipment devices.

10. The system of claim 8, wherein the instructions are further configured to cause the processors to perform operations for:

collecting operational data for the one or more downhole equipment devices; and updating a machine learning model for performing operational anomaly detection using the operational data for the one or more downhole equipment devices.

11. The system of claim 8, wherein the instructions are further configured to cause the processors to perform operations for:

generating a warning notification if the operational anomaly is detected.

12. The system of claim 8, wherein the instructions are further configured to cause the processors to perform operations for:

automatically modifying operation of at least one surface equipment device if the operational anomaly is detected.

13. The system of claim 8, wherein the instructions are further configured to cause the processors to perform operations for:

automatically modifying operation of at least one downhole equipment device if the operational anomaly is detected.

14. The system of claim 8, wherein calculating comprises providing at least a portion of the surface data and the downhole data to a machine learning model.

15. A tangible, non-transitory, computer-readable media having instructions encoded thereon, the instructions, when executed by a processor, are operable to perform operations for:

receiving surface data from one or more surface sensors, wherein the surface data comprises measurements associated with one or more surface equipment devices;

receiving downhole data from one or more downhole sensors, wherein the downhole data comprises measurements associated with operation of one or more downhole equipment devices; and analyzing a combination of the surface data and the downhole data to determine if an operational anomaly is detected with respect to the one or more surface equipment devices or the one or more downhole equipment devices, wherein analyzing the surface data and the downhole data further comprises:

calculating a failure probability of the one or more surface equipment devices or the one or more downhole equipment devices based on the combination of the surface data and the downhole data, as well as data pertaining to historic anomalies for one or more equipment types; and outputting data identifying at least one piece of equipment along with an indicator of an anomaly type, the anomaly type comprising an impending failure of the at least one piece of equipment.

16. The tangible, non-transitory, computer-readable media of claim 15, wherein the instructions are further configured to cause the processors to perform operations for:

collecting operational data for the one or more surface equipment devices; and updating a machine learning model for performing operational anomaly detection using the operational data for the one or more surface equipment devices.

17. The tangible, non-transitory, computer-readable media of claim 15, wherein the instructions are further configured to cause the processors to perform operations for:

collecting operational data for the one or more downhole equipment devices; and updating a machine learning model for performing operational anomaly detection using the operational data for the one or more downhole equipment devices.

18. The tangible, non-transitory, computer-readable media of claim 15, wherein the instructions are further configured to cause the processors to perform operations for:

generating a warning notification if the operational anomaly is detected.

19. The tangible, non-transitory, computer-readable media of claim 15, wherein the instructions are further configured to cause the processors to perform operations for:

automatically modifying operation of at least one surface equipment device if the operational anomaly is detected.

* * * * *